US009027568B2

(12) United States Patent
Lee

(10) Patent No.: US 9,027,568 B2
(45) Date of Patent: May 12, 2015

(54) HAIRPIECE HAVING DUAL PARTING AREAS

(71) Applicant: Chang Moo Lee, Moonachie, NJ (US)

(72) Inventor: Chang Moo Lee, Moonachie, NJ (US)

( * ) Notice: Subject to any disclaimer, the term of this patent is extended or adjusted under 35 U.S.C. 154(b) by 0 days.

(21) Appl. No.: 14/279,491

(22) Filed: May 16, 2014

(65) Prior Publication Data

US 2014/0251362 A1 Sep. 11, 2014

(51) Int. Cl.
*A41G 3/00* (2006.01)

(52) U.S. Cl.
CPC . *A41G 3/005* (2013.01); *A41G 3/00* (2013.01)

(58) Field of Classification Search
CPC ..... A45G 3/005; A41G 3/00
USPC ..... 132/201, 53–56
See application file for complete search history.

(56) References Cited

U.S. PATENT DOCUMENTS 6,220,249 B1 * 4/2001 Park ..... 132/53
2002/0179108 A1 * 12/2002 Harrison ..... 132/201
2009/0199861 A1 * 8/2009 Paris ..... 132/201

* cited by examiner

*Primary Examiner* — Rachel Steitz
(74) *Attorney, Agent, or Firm* — Michael J. Feigin, Esq.; Feigin & Associates, LLC

(57) ABSTRACT

A hairpiece or wig is formed of a substrate having at least two layers or sets of fibers. The hairpiece has a wig cap section which forming the core of the hairpiece to be placed on the head of an individual. The wig cap may be formed of a plurality of selectively-deformable rings adapted to adjustably conform to a head of an individual. A mesh section of the wig cap may adorn the portion of the wig cap corresponding to the forehead of the individual. The mesh section may have opposing parting areas on the left and right anterior portions of wig cap formed by recesses extending into the deformable ring portion of the wig cap. Hair strands extending from each parting area may have different shades and/or colors from one another and/or any hair strands extending from the deformable ring portion of the wig cap.

16 Claims, 8 Drawing Sheets

HAIRPIECE HAVING DUAL PARTING AREAS

FIELD OF THE DISCLOSED TECHNOLOGY

The disclosed technology relates generally to hair pieces and, more specifically, to an artificial hair wig with two parting areas and two distinct shades of hair.

BACKGROUND OF THE DISCLOSED TECHNOLOGY

There are many circumstances under which a person wishes to wear a full wig without it being obvious that it is a wig. One obvious example is for patients undergoing chemotherapy, who become temporarily or permanently bald and do not want others to note their baldness. Likewise, many individuals experience male or female pattern baldness with progression of are. Furthermore, married Jewish orthodox women are required to cover their hair, and, according to some traditions, wigs are a permissible way of doing so.

However, old-fashioned and synthetic wigs are hot, cumbersome, bulky and, from close-up, are easily discerned as being wigs as opposed to real hair. One "give-away" region is a "parting line" or "skin line" which is seen on the top of the head, typically dividing, right and left hairs along a mid-line or off-mid line along the scalp. In prior art wigs, this line may not exist or may show artificial netting, which is typically not of skin appearance. Another "give away" region is the region around the forehead and side of the head, next to the ears, where a gap can be seen between the artificial hairs of the wig and the scalp. An additional "give away" is the type of artificial hair employed. Many wigs reflect light differently to real hair and appear artificial, even at a distance.

Wigs made of cut natural hair are known in the art, but they are very expensive. Normally, a person accustomed to wearing full wigs to cover a bald head or his/her natural hair will require several different wigs. A first wig may be required for wearing without a hat with bangs (a fringe). A second wig may be required to be worn with a pony tail with the wig hair tied or gathered. A third wig may be required for wearing with an additional hair covering such as, but not limited to, a scarf, bandana, a hat, a cap and a hair-band. Further, a wearer desiring to undergo a hair color change may need difference wigs of varying shades of hair color in order to replicate the dying of ones hair. Still further, a wearer may wish to part his or her hair differently on a daily basis. This is not possible with wigs of the prior art which conventionally may have a single artificial hair parting. Thus, a wig wearing person requires a minimum of two or three wigs to suit his/her requirements, seasonal changes, and other variables.

Therefore, there is a need in the art to provide versatile hairpiece which is transformable into several different variations and looks based on different parting and hair color configurations.

SUMMARY OF THE DISCLOSED TECHNOLOGY

Therefore, it is an object of the disclosed technology to provide a hairpiece which is rearrangeable to achieve varying hair-part and/or hair color configurations.

As such, in an embodiment of the disclosed technology, a hairpiece is formed of a mesh substrate having a first set of fibers and second set of fibers. "Mesh" is defined as a semi-permeable barrier made of connected strands of material. The one-piece substrate is sized to fit the head of an individual where a "substrate" is defined as any body formed of at least two parts or layers. A plurality of selectively-deformable stabilizing rings is disposed within the substrate. "Rings" are defined as curvilinear lines of material longitudinally disposed at least partially around the circumference of the hairpiece. The stabilizing rings include a third set of substantially-concentric, monofilament fibers affixed to the mesh substrate. The set of fibers has a tensile strength which is lower than that of the first and second set of fibers.

The stabilizing rings form a central vertex which defines an inside edge of a left parting area, corresponding to a left side of the head. A "vertex", for purposes of this specification, is defined as the lowermost extreme point or edge of the stabilizing ring portion of the portion of substrate which, when worn by an individual, is closest to the glabella region of the face. The stabilizing rings further form the central vertex which defines an inside edge of a right parting area, corresponding to a right side of the head. The left and right parting areas extend towards a back of the head with the stabilizing rings extending therebetween. A plurality of hairs is attached to the substrate at, at least the left and right parting areas.

The mesh portion may cover a majority of the individuals forehead, where "majority", for purposes of this disclosure, is defined as "what an ordinary observer would consider as such" or "at least 75% being as such." A right hemispherical portion of the hairpiece is symmetrical to a left hemispherical portion of the hairpiece. The left parting area may have hair of a first distinct shade attached thereto. Likewise, the right parting area has hair of a second distinct shade attached thereto.

The hairpiece may further have hair extending from the selectively-deformable stabilizing rings and the substantially-concentric, monofilament fibers. The hair extending from the stabilizing rings and the monofilament fibers may be of the same shade of the hair attached to only one of the left parting area or the right parting area. Alternatively, the hair extending from the stabilizing rings and the monofilament fibers may have a different shade from both the hair attached to the left parting area and the hair attached to the right parting area. A "parting area" is defined as the region of the hairpiece corresponding to the crease created in the human scalp when the hair is combed or directed in opposing directions.

In another embodiment of the disclosed technology, a substrate having two layers is sized to fit a head of an individual. The substrate has a first layer composed of a piece of homogeneous fabric having a plurality of substantially-concentric, monofilament fibers extending therethrough, the first layer generally conforming to a top, back, and sides of the head. The substrate also has a second layer of mesh affixed to the first layer. The second layer is formed of a mesh weave corresponding to a front of the head and further extending towards a top of the head at two spaced apart regions corresponding to, at least, a left and right area such that a central vertex is formed in the first layer at a portion of the hairpiece corresponding to an forehead. A plurality of hairs may be attached to the substrate.

The left area and the right area curvilinearly extend towards and merge at a portion of the hair piece corresponding to a crown of the head. The merged left area and right area may form a U-shape or horseshoe shape. The plurality of hairs may have at least two different distinct shades. A "distinct shade" is defined as "A hair color which is readily recognizable as being a different hair color from another used to carry out embodiments of the disclosed technology, by a person having ordinary skill in the art and/or as is considered a different shade in the industry of hairpiece making."

In further embodiments of the disclosed hairpiece, the right area has hairs substantially of a first distinct shade extending therefrom, and the left area has hairs substantially of a second distinct shade extending therefrom. Parting the hairs at the right area results in hairs of the second distinct shade being substantially shown, covering hairs of the first distinct shade.

In a further embodiment of the disclosed technology, a method is used for producing a hairpiece. The method is carried out by fixing together a first and second layer, the first layer having a piece of homogeneous fabric having a plurality of substantially-concentric, monofilament fibers extending therethrough. The second layer has a mesh weave corresponding to a front of a head which further extends towards a top of the head. The method proceeds by attaching hair to form two parts of the hair in the second layer at spaced-apart, elongated regions of the second layer which extend into the first layer towards a crown of the head. The first part of the two parts may be of a first distinct shade and the second part of the two parts may be of a second distinct shade. That is, the hairpiece may have different shaded or colored strands of hair occupying different regions thereof.

In a further embodiment of the disclosed method, an additional step may be provided of parting the hair at the first part such that the first distinct shade is substantially shown. "Substantially" and "substantially shown", for purposes of this specification, is defined as at least a majority of at least 80% of the hairs being visible from the outside of the hairpiece, or simply "80% or more". The step of attaching hair may involve either hand tying or wefting hair strands to said hairpiece.

It should be understood that the use of "and/or" is defined inclusively such that the term "a and/or b" should be read to include the sets: "a and b," "a or b," "a," "b."

DETAILED DESCRIPTION OF EMBODIMENTS OF THE DISCLOSED TECHNOLOGY

In an embodiment of the disclosed technology, a hairpiece or wig is composed of a substrate having at least two layers or sets of fibers. The hairpiece has a wig cap section which essentially forms the core of the hairpiece to be placed on the head of an individual. The wig cap may be formed of a plurality of selectively-deformable rings adapted to adjustably conform to a head of an individual. A mesh section of the wig cap may adorn the portion of the wig cap corresponding to the forehead of the individual. The mesh section may have opposing parting areas on the left and right anterior portions of wig cap formed by recesses extending into the deformable ring portion of the wig cap. Hair strands extending from each parting area may have different shades and/or colors from one another and/or any hair strands extending from the deformable ring portion of the wig cap.

Embodiments of the disclosed technology will become clearer in view of the following description of the drawings.

Figure 1:
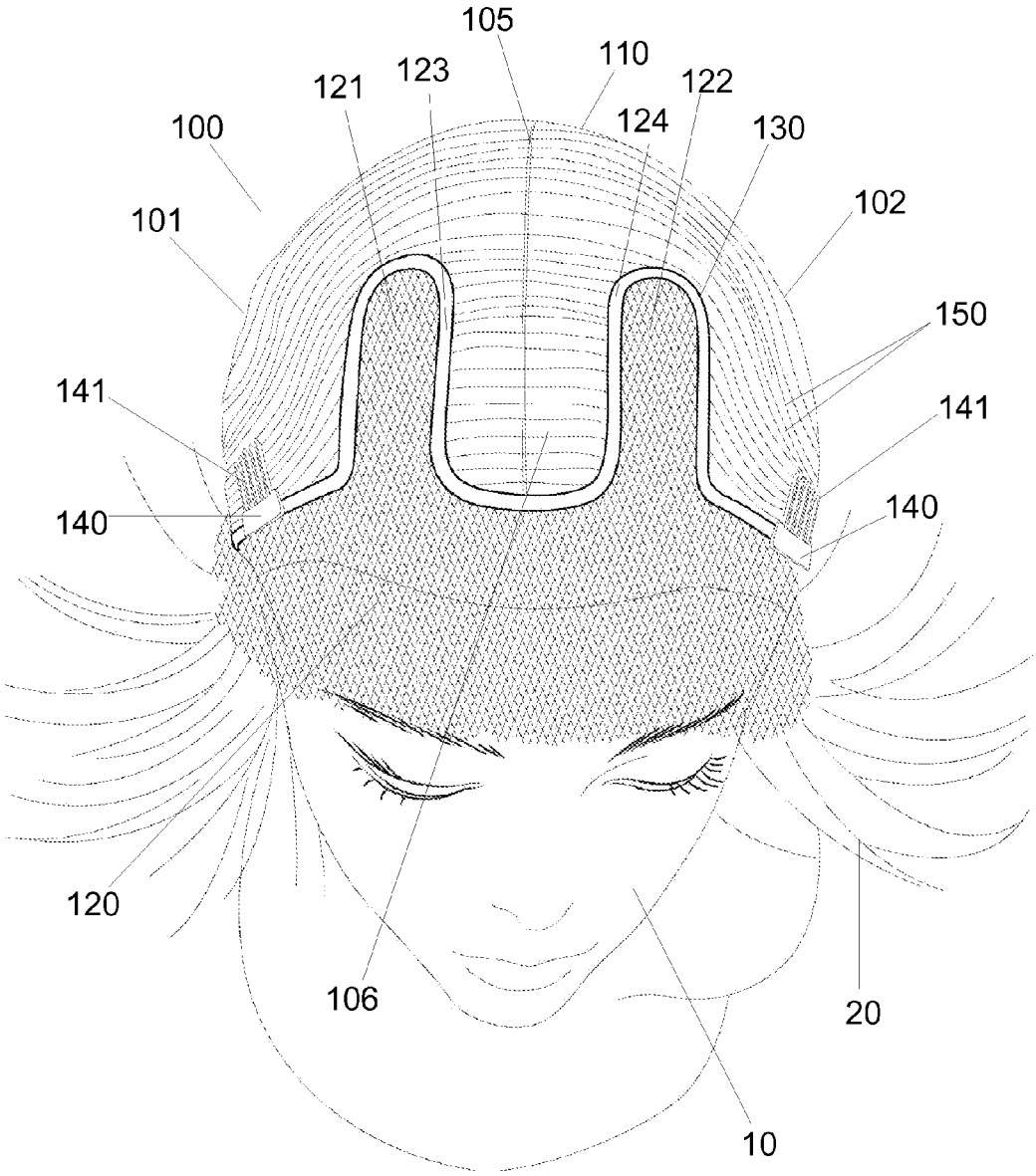
FIG. 1 shows a front isometric view of a wig cap of an embodiment of the disclosed technology.

FIG. 1 shows a front isometric view of a wig cap of an embodiment of the disclosed technology. The wig cap 100, for purposes of this specification, generally describes the entirety of the hairpiece minus the hair. The wig cap 100 may be a substrate, formed of two or more different layers or types of material. A thick, upper layer 110 may be formed of a homogeneous material having concentric rings 150. This upper layer is intended to be completely covered by the hair (not shown in FIG. 1) of the hairpiece. The rings 150 are formed of monofilament fibers which generally have a strong tensile strength compared to other materials of the wig cap 100. The rings 150 conform the wig cap 100 to a wearer's head 10. A central vertical axis line 105 separates a right hemisphere 101 and a left hemisphere 102 of the wig cap.

For purposes of this description, the human head or skull anatomically has an uppermost point, referred to as the crown. The frontal bone generally occupies the region of the head commonly referred to as the forehead. Glabella is the term used to describe the central portion of the forehead just above the bridge of the nose. When used in the specification, top or upper is the general term used to describe the orientation or direction towards the crown of the head. Likewise, bottom or lower is indicative of an orientation facing towards the chin/neck area of the human anatomy.

A relatively thin lower layer 120 is formed of mesh, silk or any other light-weight, breathable material. The mesh layer 120 may extend around the entire wig cap 100, and be covered at portions by the upper layer 110. Alternatively, the mesh layer 120 may be affixed at a lip of a lower edge 130 of the upper layer 110. The mesh layer 120, contrary to the upper layer 110, may be exposed and visible through the strands of hair extending from the wig cap 100. Thus, the mesh layer 120 is typically thin, transparent/translucent, and is colored in a flesh or dark tone in order to blend in and appear like a natural scalp/hairline of the wig wearer 10.

Parting areas 121, 122 are defined by the lower edge of the upper layer 110. The parting areas 121, 122 are formed of elongated portions of the mesh layer 120 that extend upwards and form recesses in the upper layer 110. A right parting area 121 and a left parting area 122 correspond to right and left upper portions of a wearer's forehead. The parting areas 121, 122 conform to upper portions of a frontal bone of a human skull. The parting areas 121, 122 generally correspond to the portions of a human scalp where the hair may either be naturally or artificially parted. Artificial hair may extending from a majority of the mesh of the parting areas 121, 122. "Artificial hair", for purposes of this specification, may be any type of hair which isn't naturally extending from a hairpiece wearer's scalp. That is, "artificial hair" is not limited to synthetic hair in that it may also include hair cut or removed from other mammalian species.

The parting areas 121, 122 inversely correspond to a vertex 106 formed along the central axis 105 of the upper layer 110. The vertex 106 generally corresponds to the portion of a human's forehead/scalp at which the forehead meets the hairline. The central vertex 106 may correspond to an area of a widow's peak, which is a distinct point in the hairline on some individuals carrying that particular trait. The vertex 106 is defined by the inner edges 123, 124 of the right and left parting areas, respectively.

The wig cap 100 is secured to a wearer's actual hair 20 using one or more wig clips 140 affixed along portions of the upper layer 110. The wig clips 140 have comb-like teeth 141 which engage the wearer's underlying hair 20 to hold the hairpiece in place. The wig clips 140 may or may not be visible when the hairpiece is worn. The wig clips 140, if visible, may give the appearance of a standard hair clip that an individual may use.

Figure 2:
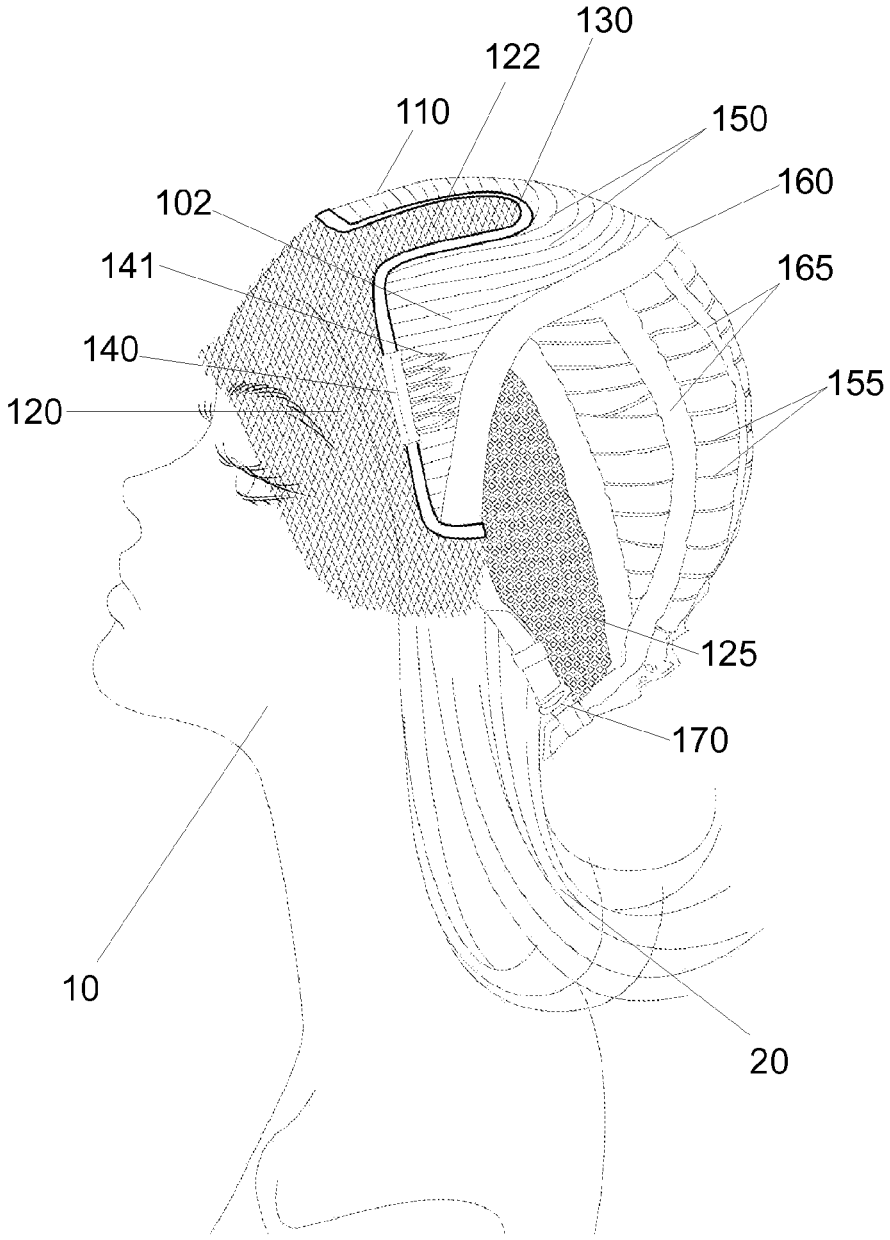
FIG. 2 shows a side elevation view of a wig cap of an embodiment of the disclosed technology.

FIG. 2 shows a side elevation view of a wig cap of an embodiment of the disclosed technology. Concentric, expandable rings 155 are disposed on a back portion of the wig cap 100. The rings 155 may be formed of elastic material to facilitate deformably placing the hairpiece on a wearer's head. Vertical rings 165 extend longitudinally along the back portion of the wig cap as well. The concentric rings 155 and the vertical rings 165 form a web or net of sorts, which conforms to different sized and shaped heads. At the base of the back portion of the wig cap 100, an adjustable strap 168 provides additional securement to a head of a user. Thus, the wig clips 140, extendable rings 155, 165 and the adjustable strap 168 all keep the hairpiece secure on a user's head. The portions 125 of the wig cap 100 nearest to a wearer's ears may also be formed of the same mesh/silk that forms the lower layer 120. These portions 125 may also be extensions of the lower layer 120 and therefore may form a single layer. This is because the portion of a wearer's head nearest to the ears may also be visible when hair is extending from the wig cap 100.

A border 160 separates the upper layer with monofilament fibers 150 from the back portion with expandable rings 155. As depicted, the natural hair 20 of a wearer 10 may extend from beneath the wig cap 100. This natural hair 20 may be blended with the artificial hair of the hairpiece.

Figure 3:
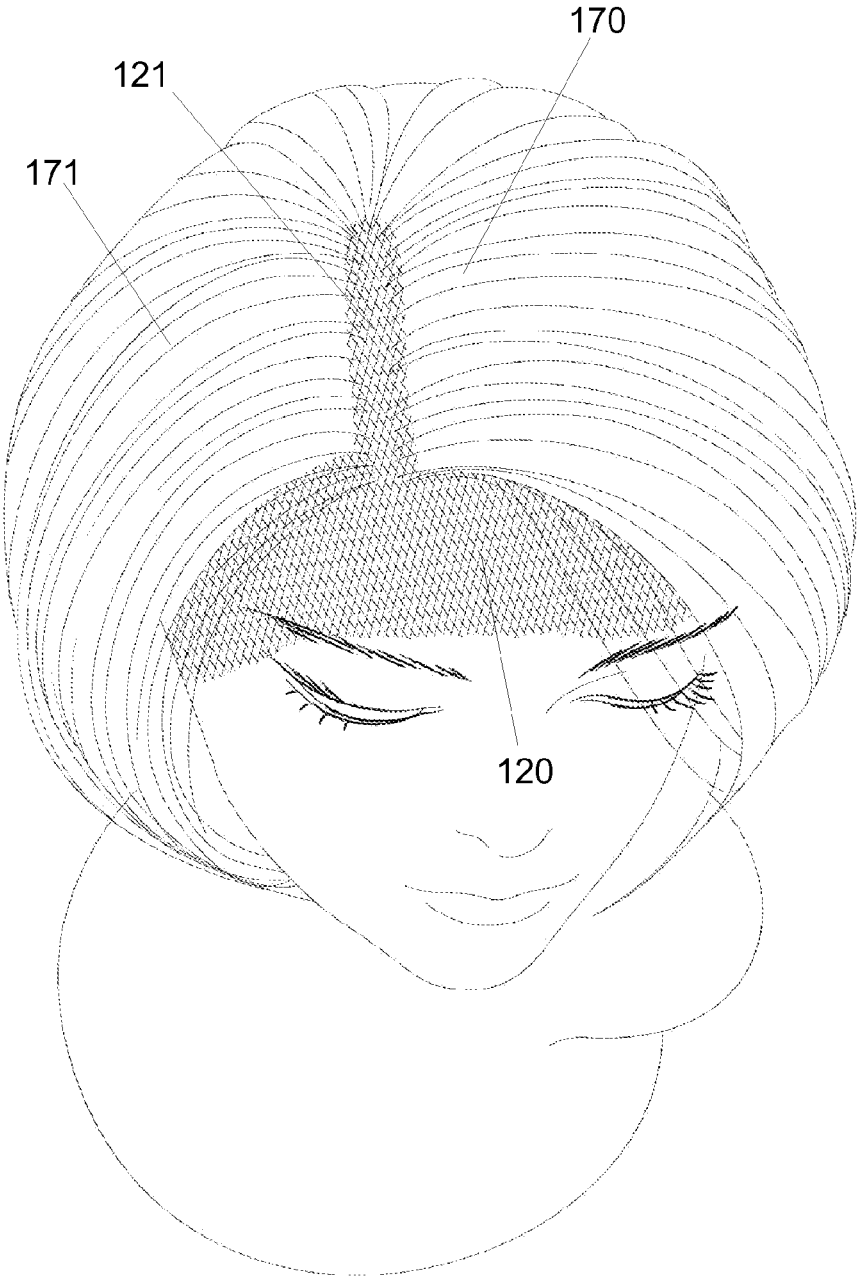
FIG. 3 shows a front isometric view of a hairpiece of an embodiment of the disclosed technology.

FIG. 3 shows a front isometric view of a hairpiece of an embodiment of the disclosed technology. Depicted is the wig cap 100 of FIG. 1, having artificial hair 170 (hereinafter collectively referred to as "artificial hair 170" or "hair 170") extending therefrom. The artificial hair extends from all portions of the wig cap 100, including the mesh layer 120, the upper layer 110, and the back portion. The hair 170 is arranged in this Figure to form a part corresponding to the right parting area 121. Visible in FIG. 3 is only hair having a first shade, color, or tone (hereinafter referred to as "first shade 171"). In the embodiment shown when the hair is parted on the right, the user appears to have hair color corresponding to the first shade 171.

Different ways of affixing the hair 170 to the wig cap 100 are possible. Firstly, hair may be affixed via hand tying. Hand tying involves the individual hair fibers being tied by hand onto the wig cap/base using a single knot. Hand tying offers styling flexibility and resembles the movement of natural hair. Alternatively, hair wefting involves weaving hair fibers into the wig cap 100. Wefting is typically done by hand sewing or machine sewing the hair fibers into the wig cap 100. As this method of attachment is faster and less natural, wefted hairpieces are generally cheaper than hand-sewn hairpieces.

Hair extending from the parting areas 121, 122 of the disclosed with cap 100 is ideally installed using hand sewing. Since the parting areas 121, 122 are typically exposed, hand sewn hair strands give a more natural appearance at the juncture between the wig cap 100 and the hair strands.

Figure 4:
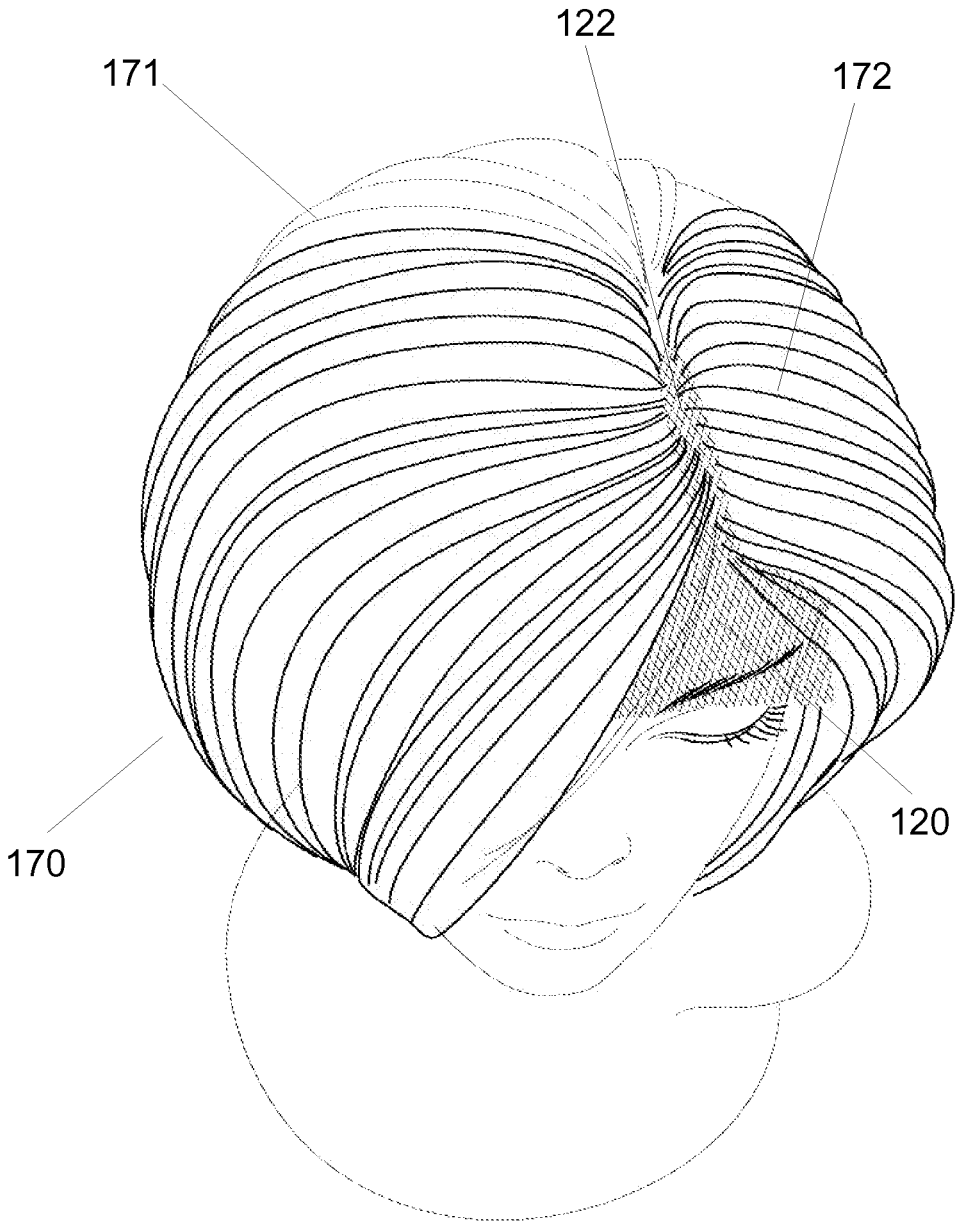
FIG. 4 shows the hairpiece of FIG. 3 with an alternative parting configuration according to an embodiment of the disclosed technology.

FIG. 4 shows the hairpiece of FIG. 3 with an alternative parting configuration according to an embodiment of the disclosed technology. In this embodiment, the hair 170 is parted on the left side at the left parting area 122. The bold strands of hair 172 (contrasted with the light strands 171) represent hair of a second shade 172. When parted on the right, the hair having the second shade 172 is covered by the hair of the first shade 171 and therefore not visible. However, should the wearer 10 desire a different look, the wearer may part the hair 170 of the hairpiece on the left in order to expose the second shade 172. As such, the hairpiece essentially provides two different configurations typically only achievable by two separate hairpieces or two separate hair styles. As depicted, hair of the first shade 171 may still be visible towards the back of the hairpiece. Alternatively, strands of the first shade 171 may also be visible on the top and front of the head to give a blended appearance (i.e. piano color/blend).

Figure 5:
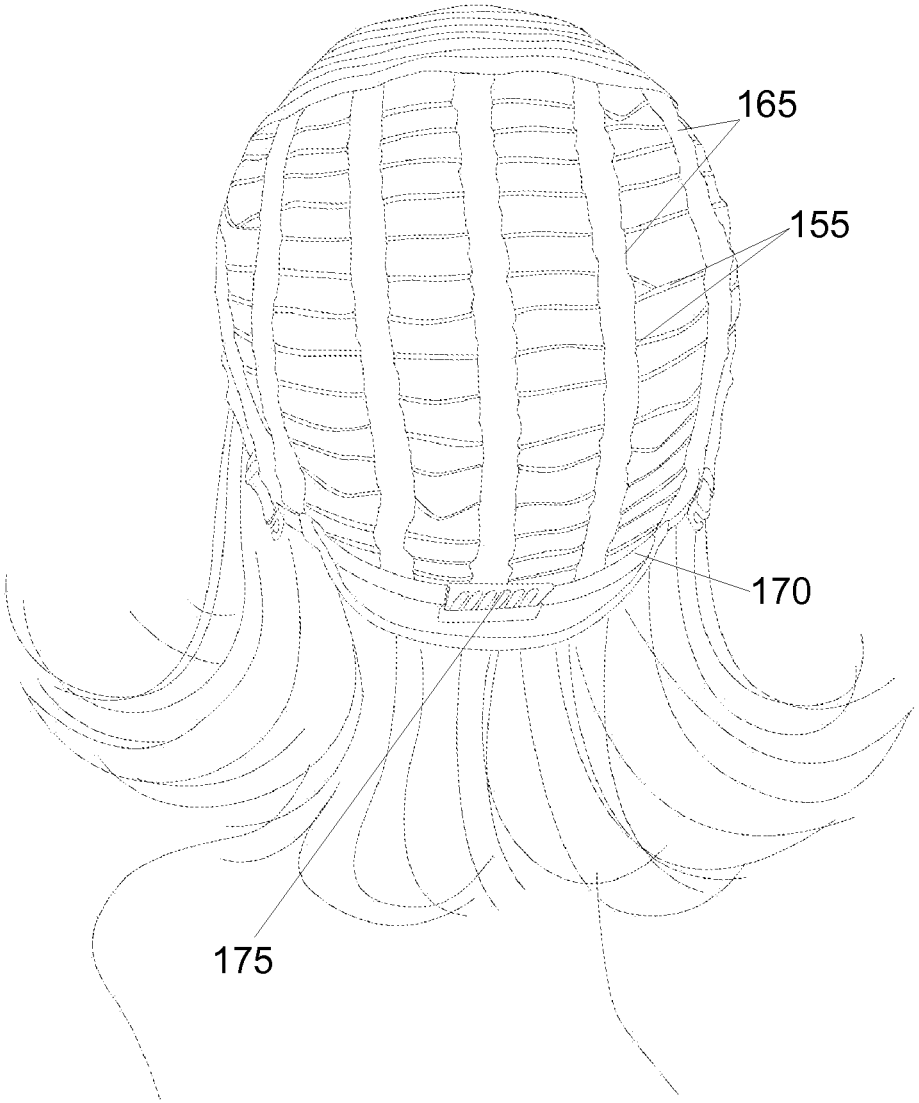
FIG. 5 shows a back view of a wig cap of an embodiment of the disclosed technology.

FIG. 5 shows a back view of a wig cap of an embodiment of the disclosed technology. The elastic rings 155 extend around the entire back portion of the wig cap 100, and form a criss-crossing lattice with the vertical rings 165. The adjustable strap 168 may have a clip 175 at a center thereof for engaging the natural hair 20 of the wearer 10. The clip 175 may also be a buckle for adjusting the length of the strap 168 to conform to the rear, base region of the head.

Figure 6:
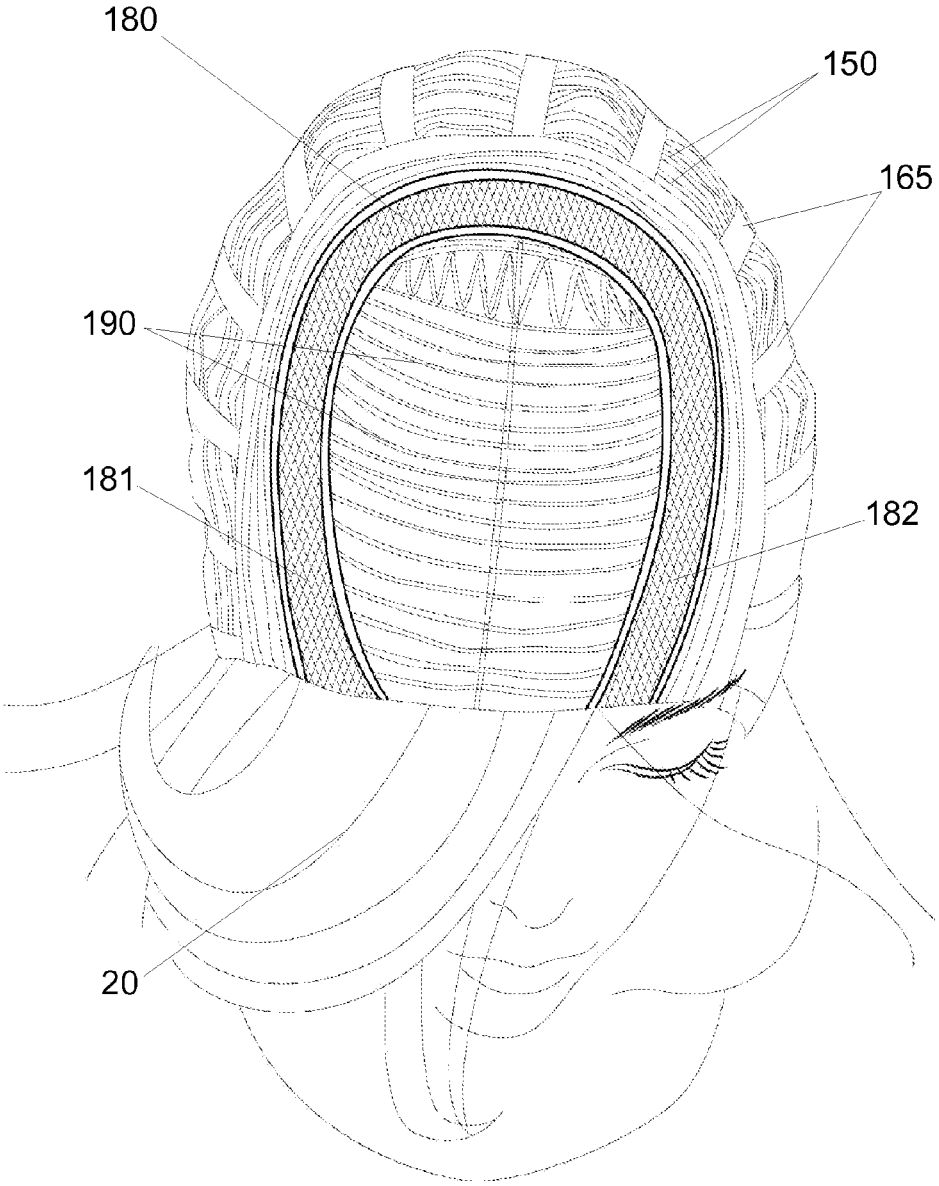
FIG. 6 shows a front isometric view of a wig cap with a U-shaped parting area according to an embodiment of the disclosed technology.

FIG. 6 shows a front isometric view of a wig cap with a U-shaped parting area according to an embodiment of the disclosed technology. In this embodiment, the parting areas 181 and 182 (also 121 or 122 of the embodiment shown in FIGS. 1 through 4) are essentially extended to meet near a crown region of the head. Thus, a single, continuous parting area 180 is formed. The parting area 180 forms a U-shape, which essentially isolates the ringed-portion 190 of the upper layer corresponding to the vertex. The U-shaped parting area 180 provides a larger parting region by which a wearer may configure certain hair styles and arrangements.

Figure 7:
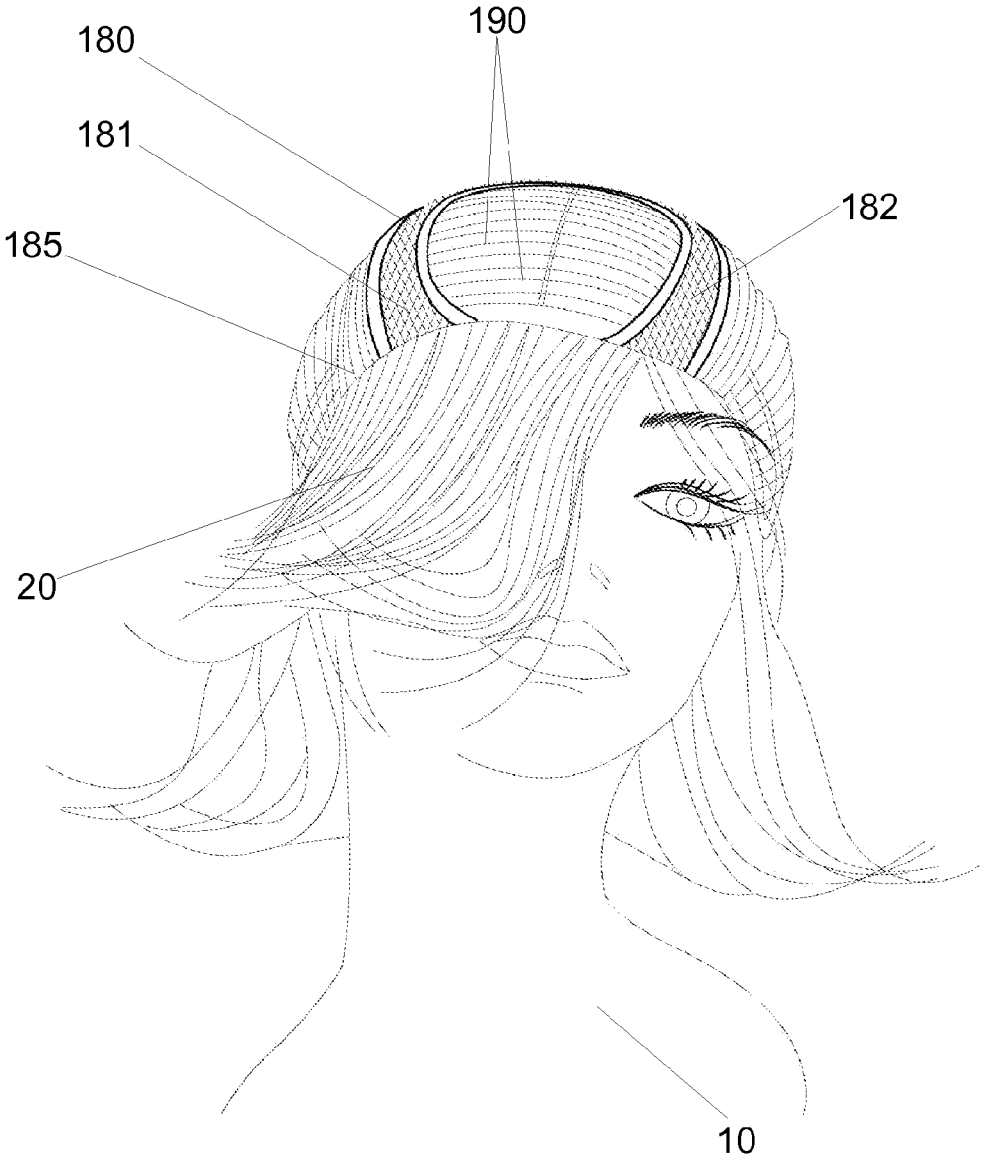
FIG. 7 shows a front view of the U-shaped wig cap of FIG. 6.

FIG. 7 shows a front view of the U-shaped wig cap of FIG. 6. As depicted, a wearer 10 may blend their natural hair 20 with that of the hairpiece by extending the natural hair from beneath the wig cap 100 at the terminal edges 185 of the wig cap. This, natural hair may be extended from beneath the forehead area of the wig cap 100 to blend the bangs and front part of a wearer with the artificial hair of the hairpiece. The parting area 180 may be formed of skin-toned lace material or mesh material. The mesh material enables hair fibers to be hand tied thereto, and allows skin to show through the mesh layer. The lace material is skin-toned, and has hair fibers or fiber wefts sewn thereto. The parting area may alternatively be formed of a combination of both lace and mesh attached to one another depending on the desired configuration.

Figure 8:
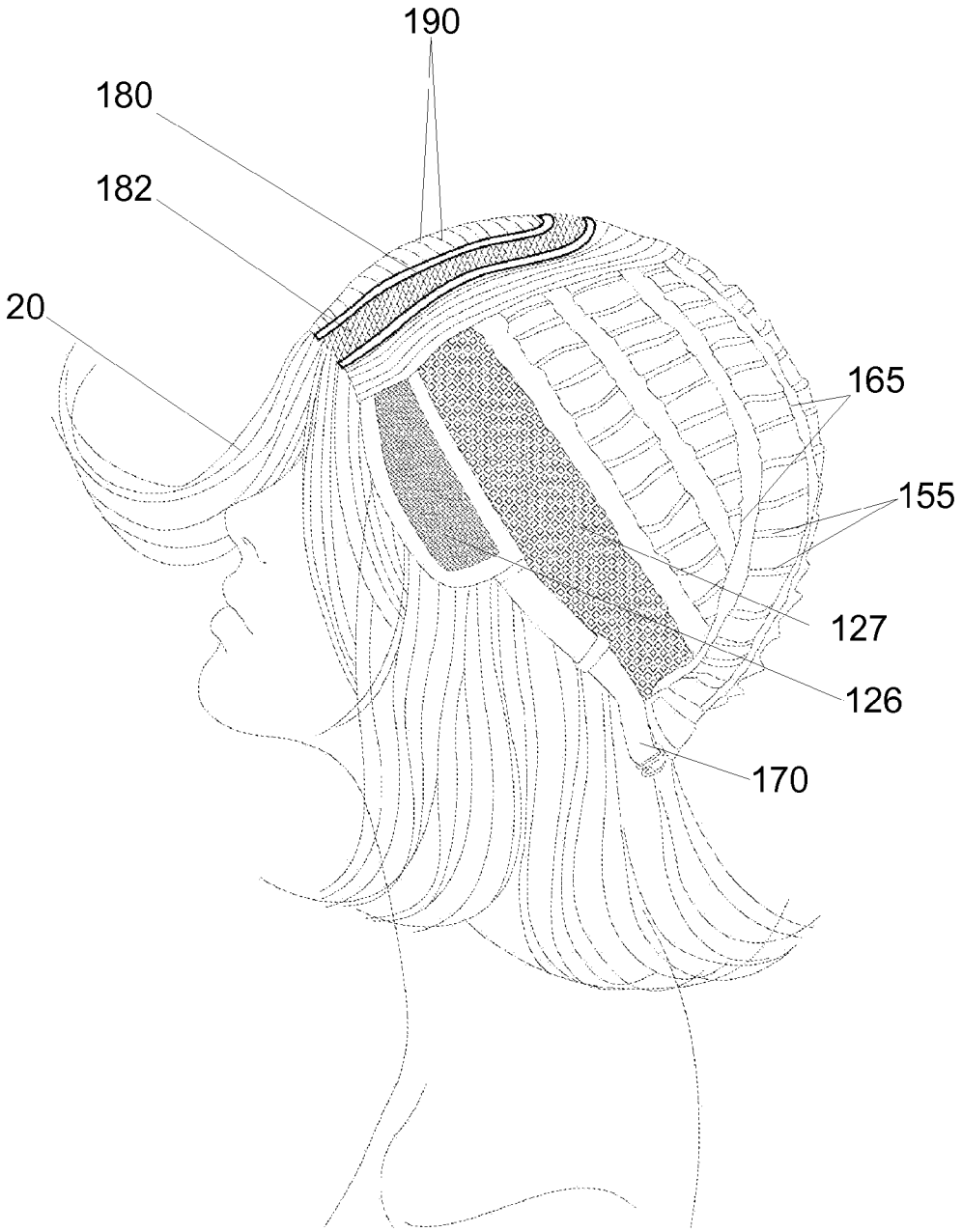
FIG. 8 shows a side elevation view of the U-shaped wig cap of FIG. 6.

FIG. 8 shows a side elevation view of the U-shaped wig cap of FIG. 6. Front ear panels 126 and rear ear panel 127 are also formed of mesh and or lace material similar to that of the parting area 180. In the embodiment shown, the ear panels 126, 127 are formed and attached separately from the parting area 180. The embodiment depicted also has expandable rings 155 and vertical rings 165 for conforming to a head 10 of a wearer. The particular arrangement of the rings 150 and 155 may vary based on the head size and shape of the user, as well as the desired appearance of the hairpiece and the type of artificial hair used.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the invention.

I claim:

1. A hairpiece comprising:

a one-piece mesh substrate sized to fit the head of an individual, said substrate including a first set of fibers and a second set of fibers;

a plurality of selectively-deformable stabilizing rings disposed within said substrate, said stabilizing rings including a third set of substantially-concentric, monofilament fibers affixed to said mesh substrate, said set of fibers having a tensile strength which is lower than a tensile strength of said first and second set of fibers, wherein said stabilizing rings form a central vertex which defines an inside edge of a left parting area, corresponding to a left side of said head, and said stabilizing rings further form said central vertex which defines an inside edge of a right parting area, corresponding to a right side of said head, said left and right parting areas extending towards a back of said head with said stabilizing rings extending therebetween; and a plurality of hairs attached to said substrate at, at least said left and right parting areas.

2. The hairpiece of claim 1, wherein:

said mesh covers a majority of an area of said wig corresponding to a forehead of said individual when donned on said head.

3. The hairpiece of claim 1, wherein:

a right and left hemispherical portion of said hairpiece are a mirror image of each other said hemispherical portion where said left and said right parting areas and said parting areas are equidistantly spaced from a center line between said right and said left hemispherical portions.

4. The hairpiece of claim 1, wherein:

said left parting area has hair of a first distinct shade attached thereto; and said right parting area has hair of a second distinct shade attached thereto.

5. The hairpiece of claim 4, further comprising:

hair of substantially only one of said first distinct shade or said second distinct shade extending from said selectively-deformable stabilizing rings and said substantially-concentric, monofilament fibers.

6. The hairpiece of claim 5, wherein:

said hair extending from said stabilizing rings and said monofilament fibers is only of the same shade of said hair attached to only one of said left parting area or said right parting area.

7. The hairpiece of claim 4, wherein:

hair is parted at said right or said left parting area, said hair extending from the other said parting area is substantially covered by said parted hair.

8. A hairpiece comprising:

a substrate sized to fit a head of an individual, said substrate having at least two layers;

a first layer composed of a piece of homogeneous fabric having a plurality of substantially-concentric, monofilament fibers extending therethrough, said first layer generally conforming to a top, back, and sides of said head;

a second layer of mesh affixed to said first layer, said second layer formed a mesh weave corresponding to a front of said head and further extending towards a top of said head at two spaced apart regions corresponding to, at least, a left and right area such that a central vertex is formed in said first layer at a portion of said hairpiece corresponding to the forehead; and a plurality of hairs attached to said substrate.

9. The hairpiece of claim 8, wherein;

said left area and said right area curvilinearly extend towards and merge at a portion of said hair piece corresponding to a crown of said head.

10. The hairpiece of claim 9, wherein said merged left area and right area form a U-shape with said first layer therebetween said U-shape and is affixed to hair.

11. The hairpiece of claim 8, wherein said plurality of hairs has at least two different distinct shades.

12. The hairpiece of claim 11, wherein:

said right area hairs substantially consist of a first distinct shade extending therefrom; and said left area hairs substantially substantially consist of a second distinct shade extending therefrom.

13. The hairpiece of claim 12, wherein;

said hairpiece comprises hair in each of said parting area such that parting in one of said right or left parting areas causes hairs connected to said other of said right or left parting area to be substantially covered by said hairs connected to said parting area which is parted.

14. A method of producing a hairpiece:

fixing together a first and second layer, said first layer comprising a piece of homogeneous fabric having a plurality of substantially-concentric, monofilament fibers extending therethrough, said second layer comprising a mesh weave corresponding to a front of a head and further extending towards a top of said head, attaching hair to form a left part and a right part of the hair in said second layer at spaced-apart, elongated regions of said second layer, wherein said elongated regions extend partially between a forehead and a crown of said head;

attaching hair of a first distinct shade to said left part of said two parts;

attaching hair of a second distinct shade to said right part of said two parts;

attaching hair of only one of said first or said second distinct shade to said first layer at, at least an area between said at least said left part and said right part and at least an area corresponding to a back of said head.

15. The method of claim 14, further comprising a step of:

parting said hair at said left part such that said first distinct shade is substantially shown and said shade extending from said right part is substantially covered.

16. The method of claim 14, further comprising a step of:

parting said hair at said right part such that said second distinct shade is substantially shown and said shade extending from said left part is substantially covered.

* * * * *